US005268553A

United States Patent [19]

Shimoji

[11] Patent Number: 5,268,553

[45] Date of Patent: * Dec. 7, 1993

[54] LASER CIGARETTE LIGHTER

[75] Inventor: Yutaka Shimoji, Clearwater, Fla.

[73] Assignee: Win International, Inc., Panama City, Fla.

[ * ] Notice: The portion of the term of this patent subsequent to Jun. 22, 2010 has been disclaimed.

[21] Appl. No.: 880,549

[22] Filed: May 8, 1992

Related U.S. Application Data

[63] Continuation-in-part of Ser. No. 806,318, Dec. 13, 1991.

[51] Int. Cl.[5] ..... B23K 26/00

[52] U.S. Cl. ..... 219/121.6; 219/121.75

[58] Field of Search ..... 219/121.6, 121.73, 121.85, 219/121.74, 121.75

[56] References Cited

U.S. PATENT DOCUMENTS

| | | | |
|---|---|---|---|
| 3,419,321 | 2/1966 | Barber et al. | 350/8 |
| 3,915,623 | 10/1975 | Wermser | 431/347 |
| 3,947,093 | 3/1976 | Goshima et al. | 350/189 |
| 4,069,080 | 1/1978 | Osborne | 219/176.75 X |
| 4,859,174 | 8/1989 | Zellweger | 431/255 |
| 4,929,174 | 5/1990 | Wang | 431/276 |

*Primary Examiner*—C. L. Albritton
*Attorney, Agent, or Firm*—Hopkins & Thomas

[57] ABSTRACT

An electrically powered portable cigarette lighter includes a laser for generating a beam of energy and means directing the beam to a point in the region of the end of a cigarette inserted into the lighter. Means are provided for preventing the beam of energy from escaping through the opening in which the cigarette is inserted.

18 Claims, 2 Drawing Sheets

LASER CIGARETTE LIGHTER

This application is a continuation-in-part of U.S. patent application Ser. No. 07/806,318 of Yutaka Shimoji, filed Dec. 13, 1991.

FIELD OF THE INVENTION

This invention relates to electrically powered cigarette lighters and, more particularly, to such a lighter utilizing a laser to generate the heat to ignite a cigarette.

BACKGROUND OF THE INVENTION

Cigarette lighters, especially those which are portable and intended to be carried in a pocket or purse, generally comprise a container or reservoir for fuel, and a nozzle or wick in communication with the reservoir and adjacent an igniter for producing a flame. Such lighters must be filled periodically, or, as is more common at present, discarded when the fuel supply is exhausted. Inasmuch as a supply of replenishing fuel is usually not available, the lighter becomes useless upon exhaustion of the fuel. The fuel itself is usually a liquified gas or a flammable liquid which often has an unpleasant odor, and it is not uncommon that the fuel will leak out of the reservoir over a period of time, which, especially in the case of flammable liquid fuel, can present a safety hazard, as does the use of an open flame. Lighters relying upon a flame are difficult to use in windy conditions, and the art is replete with devices for rendering the lighter at least partially windproof.

Lighters designed to overcome the disadvantages of fueled lighters relying upon open flame have been directed primarily to electrically activated devices which generate heat by passing current through a heating coil. In U.S. Pat. No. 3,007,027 of Hall there is shown one such lighter in which a receptacle having a heating coil therein is adapted to receive the end of a cigarette. When the body of the lighter is squeezed, current passes through the coil sufficient to heat it to a temperature sufficient to ignite a cigarette. One potential hazard with such a design is the possibility that the case, when carried in a crowded purse, for example, will be compressed enough to activate the heating coil. Inasmuch as there is no shielding mechanism, this could cause ignition of articles within the purse adjacent to the lighter.

U.S. Pat. 3,392,265 of King et al shows an electrical lighter utilizing a heating coil, which has a protective arrangement for pivoting the heating coil into the interior of the lighter away from the cigarette receptacle when the lighter is not in use, and which prevents activation of the coil in that position, thus materially reducing the fire hazard.

Lighters which use batteries to activate heating coils suffer primarily from a short battery life because of heavy current demands, hence relatively frequent battery replacement or recharging is required. In addition, the heating coil tends to collect ashes and unburned tobacco thereon which may get into the lighter interior, thereby necessitating frequent cleaning.

In U.S. Pat. No. 2,849,585 of Evans is shown an electrically operated optical arrangement for igniting the end of a cigarette in which a high intensity light bulb is used. Insertion of a cigarette end into the lighter activates an aperture switch arm and a switch to turn the light bulb on, and a condenser lens and mirror arrangement focuses the image of the bulb filament through the aperture on to the cigarette end, thereby igniting it. The electrical power to light the bulb is supplied by household current. Because the bulb generates a great deal of heat, it is necessary that there be a cooling air circulation within the lighter. Such a lighter arrangement eliminates the problems inherent in heating coil type lighters, but it is bulky, non-portable, complex and the bulb generates a great deal of heat.

SUMMARY OF THE INVENTION

The present invention is a portable cigarette lighter which is battery powered and which utilizes a unique laser system for generating heat sufficient to ignite a cigarette. The advantage of using a laser lies in the fact that the beam produced thereby is coherent, both spatially and temporally, and hence little energy is lost from the beam due to scattering or spreading of the light. The lighter of the invention relies upon the laser to generate sufficient heat at a region adjacent the end or side of a cigarette, without generating an undue amount of heat in other parts of the lighter, as is the case with a high intensity light bulb. The laser itself, when in operation, does not become dangerously overheated, the heating energy being primarily contained in the laser beam output. In order that the laser energy does not escape from the interior of the lighter, means may be provided for blocking and/or absorbing the beam after it passes the point or area of ignition of, for example, the cigarette.

In a first preferred embodiment of the invention the lighter comprises a case within which is mounted a battery power supply and a small semiconductor laser such as a gallium-aluminum-arsenide laser for producing a coherent beam. An integrated electronic circuit module is also contained within the case for receiving electrical power from the batteries and converting it to the required current and voltage for activating the laser. An optical fiber is adapted to receive the light output of the laser and transmit it to an optical system within the case. The optical system comprises in sequence a light collimating sphere, a plano-concave conic lens, a convex-plano conic lens, a focusing lens and an apertured beam blocking plate. Such an optical arrangement is designed to produce a hollow laser beam having a doughnut shaped cross-section which is focused to a point located between the focusing lens and the apertured blocking plate. The focal point defines an ignition region. Beyond the focal point the beam, which retains its doughnut shaped cross-section, expands and is blocked by the solid portion of the blocking plate surrounding the aperture, with no part of the beam escaping through the aperture.

The case has an ignition chamber formed therein and an aperture providing access to the chamber and containing a receptacle in the form of a transparent cup which is coaxial with the optical system and has a transparent bottom wall forming a plane located adjacent the focal point of the beam within the ignition chamber and hence the ignition region. The aperture and cup are adapted to receive the end of a cigarette, which rests against the bottom wall, i.e., at or adjacent the focal point of the beam. An activating switch, preferably of the push button type, is adapted to activate the electronic circuitry and hence the laser so that there is a high heat concentration at the focal point sufficient to ignite the end of a cigarette within the cup.

Indicator lights, such as light emitting diodes, are mounted on the case to indicate the state of the batteries, and to indicate when the laser is operating.

In a second preferred embodiment of the invention, the lighter case contains, or is formed in part by, a heat sink. The heat sink has a cigarette opening therein which provides ingress for the cigarette into an ignition chamber formed in the heat sink, the chamber and the opening preferably being coaxially aligned. The chamber contains a stop plate against which the cigarette butts upon insertion into the chamber through the opening, the cigarette being axially aligned with the axis of the opening and the chamber. Mounted within a recess in the heat sink adjacent the stop plate is a laser capsule containing a diode laser, or an array of diode lasers oriented to direct a laser beam in a direction transverse to the axis of the chamber and hence to the axis of the cigarette, adjacent the stop plate between the stop plate and the opening thereby forming an ignition region adjacent the stop plate. When a cigarette is inserted into the chamber and butts against the stop plate, the laser beam impinges on the cigarette against the side thereof adjacent its end thereby lighting the cigarette from the side. The recess containing the laser, and hence the laser, is protected from ash and debris by a transparent glass plate overlying the beam output edge thereof.

The ignition chamber is baffled and preferably coated with, or made of, light absorbing material so that any scattered laser light is substantially completely attenuated or absorbed. Thus, when a cigarette is inserted in the opening, the laser light is either absorbed or blocked and cannot exit the chamber. In addition, the lighter case may have a colored, laser light attenuating glass opening into the chamber for observing the ignition of the cigarette, and the chamber may be vented to the outside through vent slots in the case.

Either or both embodiments of the invention may be equipped with a safety lock which prevents activation of the laser unless a cigarette is inserted in the lighter. Such a safety lock may comprise, for example, a light emitting diode (LED) and a photodetector mounted inside the lighter immediately adjacent the opening that receives the cigarette. The photodetector is connected to a field effect transistor circuit with the electronic circuit module which activates the laser when a signal from the photodetector is received. If a cigarette is not inserted through the opening and the activating switch is closed, the LED will emit light, most of which will be directed away from the photodetector and absorbed, thereby having no effect on the photodetector and hence the laser is not activated.

On the other hand, when a cigarette is inserted into the lighter through the opening and the activating switch is closed, a significant portion of the light emitted by the LED will be reflected off of the cigarette to the photodetector, which sends a signal to the FET circuit which, in turn, activates the laser. With such a safety lock, the laser, and hence the lighter, can only be activated when a cigarette is in place in the lighter.

The lighter of the invention is light in weight and readily portable. Any heat that is generated is concentrated at a point or absorbed by the heat sink so that the body of the lighter remains cool. There is no danger that the laser beam might exit the lighter with a consequent potential for damage, especially to the users eyes, and any ash or unburned tobacco particles are blocked from the interior of the lighter containing the laser.

The numerous features and advantages of the present invention will be more readily apparent from the following detailed description, read in conjunction with the accompanying drawings.

DETAILED DESCRIPTION

Figure 1:
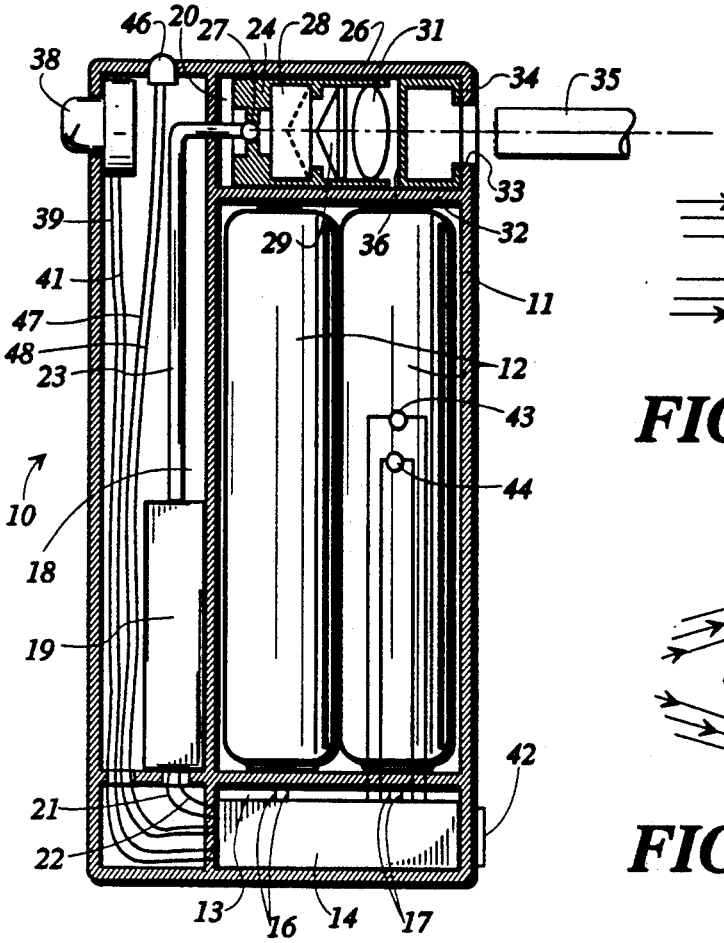
FIG. 1 is a side elevational view, in cross-section, of a first illustrative embodiment of the lighter of the present invention.

FIG. 1 depicts the lighter 10 of the present invention in a first illustrative embodiment, which comprises a hollow case 11 of metal, high impact plastic, or other suitable material, having mounted and supported therein a suitable power supply 12 which may comprises replaceable AA batteries or a suitable rechargeable battery. Mounted in a compartment 13 beneath the power supply 12 is an integrated circuit module 14 which receives power from supply 12 via leads 16 and 17. Also mounted within case 11 in a compartment 18 is a laser device 19. Laser 19 may be any of a number of suitable devices, such as a gallium-aluminum-arsenide (Ga Al As) laser which generates a substantially spatially and temporally coherent beam of energy. Laser 19 is adapted to be actuated by module 14 via leads 21 and 22. While the power supply, the electronic module, and the laser have been shown as separate entities within the case 11, in practice they may be packaged as a single unit, with the batteries 12 being easily replaceable.

Figure 2A:
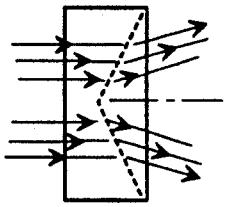
FIG. 2A is a side elevational view of the plano-concave conical lens of the lighter of FIG. 1.
Figure 2B:
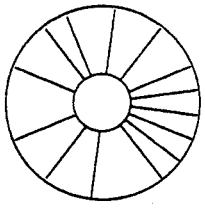
FIG. 2B is a front elevational view of the lens of FIG. 2A.
Figure 3A:
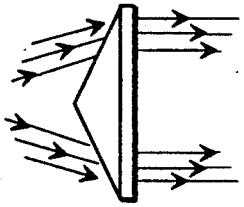
FIG. 3A is a side elevational view of the convex-plano conical lens of the present invention.
Figure 3B:
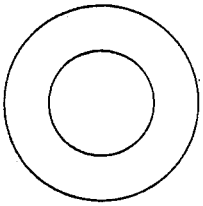
FIG. 3B is a front elevational view of the lens of FIG. 3A.
Figure 4A:
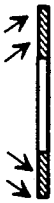
FIG. 4A is a side view, in cross-section, of the beam blocking plate of the lighter of FIG. 1.
Figure 4B:
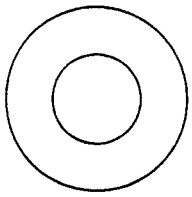
FIG. 4B is a front view of the beams blocking plate of FIG. 4A.
Figure 5:
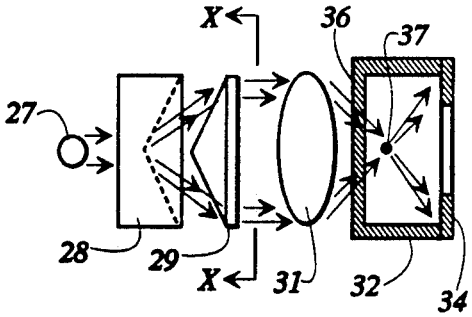
FIG. 5 is a diagram of the path of laser light incident upon the optical system of the lighter of FIG. 1.
Figure 6:
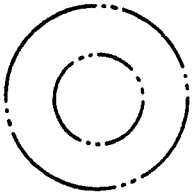
FIG. 6 is a cross-section of the light beam along the line X—X in FIG. 5.

An optical fiber 23 is connected at one end to the output of laser 19, and at the other end to an optical system 24 which is contained within an ignition chamber 20 within case 11 at the top thereof. Optical system 24 comprises a support sleeve 26, preferably of a clear plastic material, within which are mounted in axial alignment and in sequence a collimator 27, a plano-concave conical lens 28, a convex-plano conical lens 29, and a focusing lens 31. Collimator 27, which may be, for example, a Melles-Griot collimating sphere, is adapted to receive the laser output from the end of fiber 23 and collimate it. Lens 28 which may be of optical glass or optical grade plastic having, for example, an index of refraction of approximately 1.57, and a conical pitch of approximately sixty degrees (60), is adapted to receive the laser light from the collimator 27 and to create, as best seen in FIG. 2A and FIG. 5, a spreading beam having a doughnut shaped cross-section. Lens 29, which, like lens 28, has a conical surface of approximately sixty degrees pitch and may be of glass or plastic and has an index of refraction of approximately 1.57, is adapted to receive the spreading doughnut shaped beam from lens 28 and focus it as a substantially parallel linear, hollow beam having a doughnut shaped cross-section onto focusing lens 31, as best seen in FIG. 3A and FIG. 5.

A transparent cup 32 of clear plastic or glass is mounted within case 11 in axial alignment with the optical system 24, and has an open end adjacent an aperture 33 in case 11. Between the open end of cup 32 and aperture 33 is an apertured beam blocking plate 34 which may be made, for example, of anodized aluminum. Cup 32 is adapted to receive a cigarette 35 which is inserted through aperture 33, the aperture in plate 34, and the open end of the cup, and which butts against the bottom 36 of the cup 32. As best seen in FIG. 5, focusing lens 31 is adapted to receive the doughnut cross-sectioned beam from conical lens 29 and focus it to a focal point 37 which is adjacent the plane of cup bottom 36. The focal point defines an ignition region within the ignition chamber which is adjacent the bottom 36 of cup 32. Thus, the cigarette end bearing against bottom 36 will be at the point of maximum light intensity, which raises a temperature sufficient to ignite the cigarette.

The lighter 10 of the present invention is activated by, for example, a push button switch 38 which communicates with the module 14 via leads 39 and 41, as seen in FIG. 1. It is to be understood that other arrangements for activating the lighter might be used, that shown here being by way of example only. When an externally protruding push button type switch is used, there exists the possibility that the lighter might be inadvertently activated. While little or no damage would result from such activation, it could result in an unnecessary and unwanted drain on the batteries. In order to decrease the possibilities of inadvertent activation, a rotatable key 42 is provided. Key 42 preferably has an "ON" position and an "OFF" position, and is connected to module 14 to prevent it from operating when key 42 is in the "OFF" position.

Module 14 may be designed to monitor the condition of power supply 12, and to indicate its condition by means of light emitting diodes 43 and 44. Diode 44 may emit green light, and is activated when power supply 12 has sufficient energy to activate laser 19. On the other hand, diode 43 may emit red light and is activated when the energy of power supply 12 is insufficient. Despite a green indication by diode 44, it is desirable that the operator know when laser 19 is operating, and to this end a light emitting diode 46, which is connected to laser 19 via leads 47 and 48 is adapted to emit light when the laser 19 is operating. It is to be understood that other indicating arrangements might be used, those shown here being by way of example only.

Figure 7:
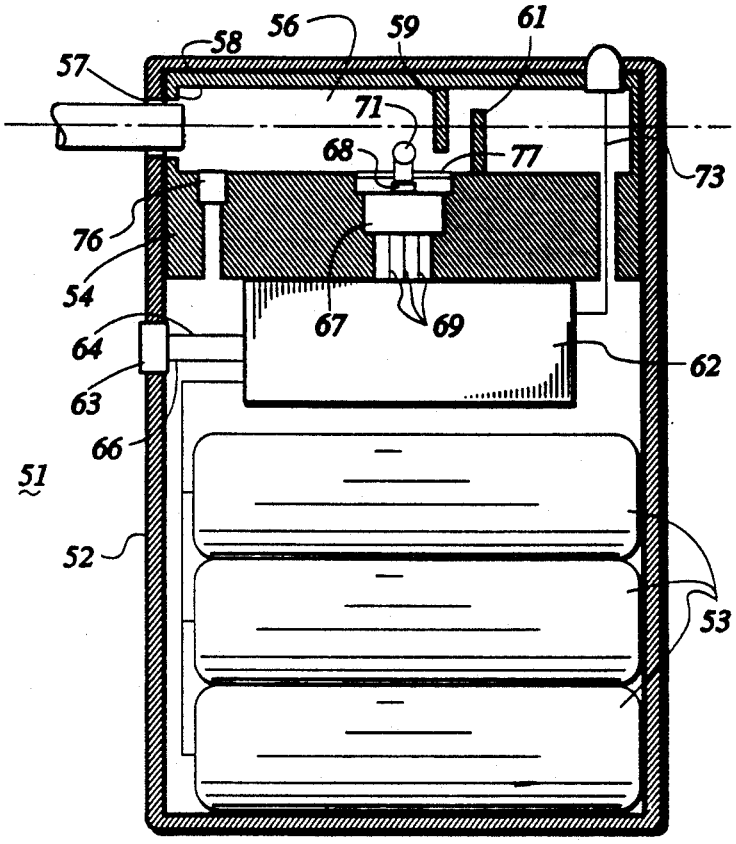
FIG. 7 is a side elevation view, in cross section, of a second illustrative embodiment of the invention.

In FIG. 7 there is shown a second illustrative embodiment of the invention which substantially eliminates the need for a focusing system for the laser beam.

The lighter 51 of this embodiment comprises a substantially hollow case 52 of metal, high impact plastic, or other suitable material which contains a power supply 53 of suitable batteries, such as, for example, 1.5 volt AA batteries. Located within the upper portion of case 52 is a heat sink member 54, preferably of aluminum or other heat absorbing material having an ignition chamber 56 formed therein. Access to the ignition chamber 56 for the article to be ignited is through an aperture 57 in case 52 and an aperture 58 in heat sink member 54, preferably coaxial with aperture 57 and chamber 56. A stop plate 59 is located within chamber 56 is positioned to stop the end of the article or cigarette at the ignition region of the chamber. A baffle plate 61 is also located within chamber 56, and the surfaces of the chamber 56, stop plate 59, and baffle plate 61 are preferably coated with a light absorbing material or heat sink member may be of black anodized aluminum. The term "light absorbing" may include light waves both above and/or below the visible range of light, such as, for example, infra-red.

Mounted with case 52 is an electronic control circuit module 62 which receives power from power supply 53. Control module 62 is activated by a switch 63 connected thereto by leads 64 and 66. Switch 63 may take any of a number of forms, such as, for example, a simple push button switch. Mounted within a bore in heat sink member 64 is a laser module 67 having a diode laser 68 thereon, and connected to control module 62 by leads 69, 69. Diode laser 68 is preferably an elongated array of a plurality of diodes which emits a beam having, for example, a length along the array of 5000 microns and a width of approximately one-half micron ($0.5\mu$). Thus, the laser beam is of a substantially flat planar shape. A cylindrical focusing member 71 is positioned directly above the array 68 to prevent too great a beam spread in the width of the beam and consequently, loss of beam energy, and the beam is directed to and through an ignition region immediately in front of stop plate 59. The direction of the beam is transverse to the axis of the apertures 57 and 58 and chamber 56. It is possible that the beam which, when a diode array is used, may contain as much as ten watts of power, may retain sufficient energy within the ignition region to light the cigarette without focusing, in which case focusing member 71 is not necessary. When the end of the cigarette is butted against plate 59, the actual ignition point on the cigarette will be on its side, but closely adjacent the end that is butting against plate 59.

A light emitting diode 72, connected to control circuit module 62 by lead or leads 73, indicates when laser assembly 68 is operating. In addition, lighter 51 may be equipped with battery condition indicators such as diodes 43 and 44 of the lighter of FIG. 1.

Figure 8:
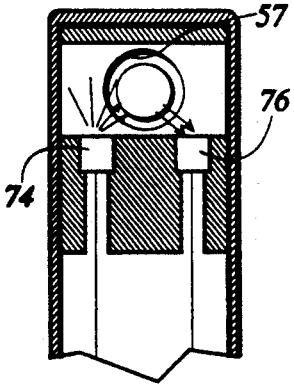
FIG. 8 is a partial cross-sectional view of the front of the lighter of FIG. 7, illustrating a safety lock arrangement.

Lighter 51 may be equipped with a safety inter-lock arrangement such as that shown in FIG. 8. The interlock arrangement comprises a light emitting diode 74 and a photodetector 76, mounted side by side in bores in heat sink 54 adjacent aperture 58. In the absence of a cigarette within chamber 56, LED 74 emits light mostly upward toward the top of chamber 56, and there is insufficient scattering of the light for detector 76 to be activated. However, when a cigarette is in place within chamber 56, a large portion of the light emitted by LED 74 is reflected by the cigarette toward detector 76, which is then actuated. The signal from detector actuates a switch, such as a field effect transistor within circuit module 62 to turn laser 68 on. With such an arrangement, without a cigarette inserted into chamber 56, actuation of switch 63 will not turn laser 68 on, hence the laser 68 can only be turned on if a cigarette is in place. The safety inter-lock arrangement as just described may also be used in the lighter 10 of FIG. 1.

To prevent ash and tobacco from impinging upon laser module 67 and laser 68, a glass cover 77 is provided to protect the laser 68 and module 67.

Figure 9:
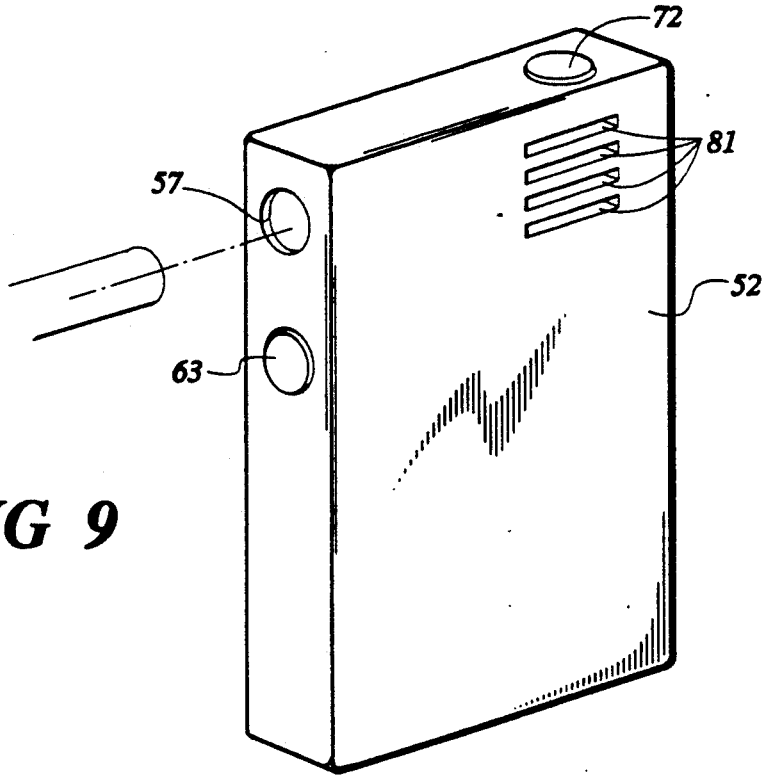
FIG. 9 is a perspective view of the exterior of the lighter of FIG. 7.

FIG. 9 depicts the lighter of FIG. 8. As can be seen, for additional cooling of the interior of the lights, case 52 and heat sink 54 have a plurality of cooling slots 81, 81 therein, venting the ignition chamber to the outside.

It can be appreciated from the foregoing that the lighter of the present invention is small and portable; is safe to use; does not represent a safety hazard if inadvertently actuated; and is protected from ash and tobacco particle intrusion into the interior thereof. While the invention has been described as a cigarette lighter, conversion to a cigar lighter would only require an opening and a cup of sufficient size to accommodate the end of a cigar.

The foregoing description has been directed to preferred illustrative embodiments of the invention. Numerous other embodiments, changes and alterations may occur to workers in the art without departure from the spirit and scope of the invention.

I claim:

1. An electrically powered lighter for igniting cigarettes and like articles comprising:
- a substantially hollow case having an opening therein,
- an ignition chamber within said case, said chamber having an ignition region therein and being accessible through said opening,
- means for locating the end of the article to be ignited adjacent the ignition region, and
- laser means within said case for generating a coherent beam of energy and directing it through said ignition region.

2. An electrically powered lighter as claimed in claim 1 wherein said ignition chamber and said opening are substantially coaxial.

3. An electrically powered lighter as claimed in claim 2 wherein said laser means is oriented to direct said coherent beam to said ignition region in a direction substantially transverse to the axis of said opening and said chamber.

4. An electrically powered lighter as claimed in claim 2 wherein said laser means includes means for directing said coherent beam of energy in a direction substantially axially of said opening and said chamber.

5. An electrically powered lighter as claimed in claim 1 and further comprising means for attenuating said coherent beam after passage through said ignition region.

6. An electrically powered lighter for igniting cigarettes and the like comprising:
- a housing having an ignition chamber therein,
- an opening in said housing for introducing an end of the article to be ignited into said ignition chamber,
- means including a laser member within said housing for directing a beam of substantially coherent energy into said ignition chamber, and
- means for activating said laser member.

7. An electrically powered lighter as claimed in claim 6 wherein said means for activating said laser member comprises a control circuit and an activating switch for energizing said laser member.

8. An electrically powered lighter as claimed in claim 7 and further comprising a power supply means within said housing for supplying electrical power to said control circuit.

9. An electrically powered lighter for lighting cigarettes and the like comprising:
- a case,
- an aperture in said case for permitting passage of one end of a cigarette into said case,
- and means within said case for directing a laser beam toward a point adjacent the end of the cigarette.

10. An electrically powered lighter as claimed in claim 9 wherein said means for directing the laser beam directs it in a direction transverse to the axis of the cigarette.

11. An electrically powered lighter as claimed in claim 9 wherein said means for directing the laser beam directs it in a direction coaxial with the axis of the cigarette.

12. An electrically powered lighter for igniting cigarettes and the like comprising:
- a substantially hollow case having an opening therein,
- means within said case forming an ignition chamber having a longitudinal axis,
- a power supply within said case,
- means within said chamber defining an ignition region,
- laser means within said case for producing a coherent beam of energy, said laser means being oriented relative to said chamber to direct said beam of energy across said chamber and through the ignition region, and
- means for activating said laser means.

13. An electrically powered lighter as claimed in claim 12 wherein said laser means comprises an array of diode lasers extending transversely of the longitudinal axis of said ignition chamber.

14. An electrically powered lighter as claimed in claim 12 and further comprising means for focusing said beam of energy toward said ignition region.

15. An electrically powered lighter for igniting cigarettes and the like comprising:
- a substantially hollow case,
- an ignition chamber within said case,
- an opening in said case for providing access to said ignition chamber,
- means within said chamber defining an ignition region,
- a power supply means within said case,
- laser means within said case for producing a coherent beam of energy,
- control circuit means within said case for receiving power from said power supply means and applying power when activated to said laser means,
- first means having an activating state for activating said control circuit means, and
- lock means within said ignition chamber for maintaining said control circuit deactivated, said lock means including detecting means for detecting the presence of an article to be ignited within said chamber and activating said control circuit when said first means is in its activating position.

16. An electrically powered lighter as claimed in claim 15 wherein said detecting means comprises a light emitting device within said chamber and a light detecting device within said chamber.

17. An electrically powered lighter as claimed in claim 16 wherein said light emitting device and said light detecting device are mounted adjacent each other within said chamber.

18. An electrically powered lighter as claimed in claim 17 wherein said light emitting device and said light detecting device are mounted within said chamber adjacent said opening in said case.

* * * * *